US007823645B2

(12) United States Patent
Henriksen et al.

(10) Patent No.: US 7,823,645 B2
(45) Date of Patent: Nov. 2, 2010

(54) DOWNHOLE INFLOW CONTROL DEVICE WITH SHUT-OFF FEATURE

(75) Inventors: Knut Henriksen, Houston, TX (US); Craig Coull, Kingwood, TX (US); Erik Helsengreen, Tananger (NO)

(73) Assignee: Baker Hughes Incorporated, Houston, TX (US)

( * ) Notice: Subject to any disclaimer, the term of this patent is extended or adjusted under 35 U.S.C. 154(b) by 312 days.

(21) Appl. No.: 11/842,688

(22) Filed: Aug. 21, 2007

(65) Prior Publication Data

US 2008/0035350 A1 Feb. 14, 2008

Related U.S. Application Data

(62) Division of application No. 11/193,182, filed on Jul. 29, 2005, now Pat. No. 7,409,999.

(60) Provisional application No. 60/592,496, filed on Jul. 30, 2004.

(51) Int. Cl.
*E21B 43/12* (2006.01)
*E21B 43/14* (2006.01)

(52) U.S. Cl. ..... 166/313; 166/50

(58) Field of Classification Search ..... 166/313, 166/50

See application file for complete search history.

(56) References Cited

U.S. PATENT DOCUMENTS 1,362,552 A 12/1920 Alexander et al.
1,649,524 A 11/1927 Hammond
1,915,867 A 6/1933 Penick (Continued)

FOREIGN PATENT DOCUMENTS

CN 1385594 12/2002

(Continued)

OTHER PUBLICATIONS

Restarick, Henry, Halliburton Energy Services, SPE Member; SPE 29831 Horizontal Completion Options In Reservoirs With Sand Problems; Presented at the SPE Middle East Oil Show, Behrain, Mar. 11-14, 1995; Copyright 1995, Society of Petroleum Engineers, Inc.

(Continued)

*Primary Examiner*—Hoang Dang
(74) *Attorney, Agent, or Firm*—Mossman, Kumar & Tyler PC

(57) ABSTRACT

A system and method for controlling inflow of fluid into a production string. In aspects, the invention provides a downhole sand screen and inflow control device with a gas or water shut-off feature that can be operated mechanically or hydraulically from the surface of the well. The device also preferably includes a bypass feature that allows the inflow control device to be closed or bypassed via shifting of a sleeve. In embodiments, the flow control device can be adaptive to changes in wellbore conditions such as chemical make-up, fluid density and temperature. Exemplary adaptive inflow control devices include devices configured to control flow in response to changes in gas/oil ratio, water/oil ratio, fluid density and/or the operating temperature of the inflow control device. In other aspects of the present invention, inflow control devices are utilized to control the flow of commingled fluids drained via two or more wellbores.

22 Claims, 9 Drawing Sheets

U.S. PATENT DOCUMENTS 1,984,741 A 12/1934 Harrington
2,089,477 A 8/1937 Halbert
2,119,563 A 6/1938 Wells
2,214,064 A 9/1940 Niles
2,257,523 A 9/1941 Combs
2,412,841 A 12/1946 Spangler
2,762,437 A 9/1956 Egan et al.
2,810,352 A 10/1957 Tumilson
2,814,947 A 12/1957 Stegemeier et al.
2,942,668 A 6/1960 Maly et al.
2,945,541 A 7/1960 Maly et al.
3,326,291 A 6/1967 Zandmer
3,385,367 A 5/1968 Kollsman
3,419,089 A 12/1968 Venghiattis
3,451,477 A 6/1969 Kelley
3,675,714 A 7/1972 Thompson
3,739,845 A 6/1973 Berry et al.
3,791,444 A 2/1974 Hickey
3,876,471 A 4/1975 Jones
3,918,523 A 11/1975 Stuber
3,951,338 A 4/1976 Genna
4,173,255 A 11/1979 Kramer
4,180,132 A 12/1979 Young
4,186,100 A 1/1980 Mott
4,248,302 A * 2/1981 Churchman ..... 166/272.1
4,250,907 A 2/1981 Struckman et al.
4,257,650 A * 3/1981 Allen ..... 166/272.3
4,287,952 A 9/1981 Erbstoesser
4,415,205 A * 11/1983 Rehm et al. ..... 299/5
4,434,849 A * 3/1984 Allen ..... 166/272.3
4,491,186 A 1/1985 Alder
4,497,714 A 2/1985 Harris
4,552,218 A 11/1985 Ross et al.
4,572,295 A 2/1986 Walley
4,614,303 A 9/1986 Moseley, Jr. et al.
4,649,996 A 3/1987 Kojicic et al.
4,821,800 A 4/1989 Scott et al.
4,856,590 A 8/1989 Caillier
4,917,183 A 4/1990 Gaidry et al.
4,974,674 A 12/1990 Wells
4,998,585 A 3/1991 Newcomer et al.
5,004,049 A 4/1991 Arterbury
5,016,710 A * 5/1991 Renard et al. ..... 166/245
5,156,811 A 10/1992 White
5,333,684 A 8/1994 Walter et al.
5,337,821 A 8/1994 Peterson
5,339,895 A 8/1994 Arterbury et al.
5,377,750 A 1/1995 Arterbury et al.
5,381,864 A 1/1995 Nguyen et al.
5,431,346 A 7/1995 Sinaisky
5,435,393 A 7/1995 Brekke et al.
5,435,395 A 7/1995 Connell
5,439,966 A 8/1995 Graham et al.
5,551,513 A 9/1996 Surles et al.
5,586,213 A 12/1996 Bridges et al.
5,597,042 A 1/1997 Tubel et al.
5,609,204 A 3/1997 Rebardi et al.
5,673,751 A 10/1997 Head et al.
5,803,179 A 9/1998 Echols
5,831,156 A 11/1998 Mullins
5,839,508 A 11/1998 Tubel et al.
5,873,410 A 2/1999 Iato et al.
5,881,809 A 3/1999 Gillespie et al.
5,982,801 A 11/1999 Deak
6,068,015 A 5/2000 Pringle
6,112,815 A 9/2000 Boe et al.
6,112,817 A 9/2000 Voll
6,228,812 B1 5/2001 Dawson et al.
6,253,847 B1 7/2001 Stephenson
6,253,861 B1 7/2001 Carmichael et al.
6,273,194 B1 8/2001 Hiron
6,305,470 B1 10/2001 Woie
6,367,547 B1 4/2002 Towers et al.
6,371,210 B1 4/2002 Bode et al.
6,372,678 B1 4/2002 Youngman et al.
6,419,021 B1 * 7/2002 George et al. ..... 166/313
6,474,413 B1 11/2002 Barbosa et al.
6,505,682 B2 * 1/2003 Brockman ..... 166/250.15
6,516,888 B1 2/2003 Gunnerson et al.
6,581,681 B1 6/2003 Zimmerman et al.
6,622,794 B2 9/2003 Zisk
6,632,527 B1 10/2003 McDaniel et al.
6,635,732 B2 10/2003 Mentak
6,667,029 B2 12/2003 Zhong et al.
6,679,324 B2 1/2004 Boer et al.
6,692,766 B1 2/2004 Rubinstein et al.
6,699,503 B1 3/2004 Sako et al.
6,699,611 B2 3/2004 Kim et al.
6,786,285 B2 9/2004 Johnson et al.
6,817,416 B2 11/2004 Wilson et al.
6,840,321 B2 * 1/2005 Restarick et al. ..... 166/313
6,863,126 B2 * 3/2005 McGlothen et al. ..... 166/242.1
6,938,698 B2 9/2005 Coronado
6,951,252 B2 * 10/2005 Restarick et al. ..... 166/313
6,976,542 B2 12/2005 Henriksen et al.
7,084,094 B2 8/2006 Gunn et al.
7,159,656 B2 1/2007 Eoff et al.
7,185,706 B2 3/2007 Freyer
7,318,472 B2 1/2008 Smith
7,322,412 B2 1/2008 Badalamenti et al.
7,325,616 B2 2/2008 Lopez de Cardenas et al.
7,395,858 B2 7/2008 Barbosa et al.
7,409,999 B2 8/2008 Henriksen et al.
2002/0125009 A1 9/2002 Wetzel et al.
2003/0221834 A1 * 12/2003 Hess et al. ..... 166/313
2004/0052689 A1 3/2004 Yao
2004/0144544 A1 7/2004 Freyer
2004/0194971 A1 10/2004 Thomson
2005/0016732 A1 1/2005 Brannon et al.
2005/0126776 A1 6/2005 Russell
2005/0171248 A1 8/2005 Li et al.
2005/0178705 A1 8/2005 Broyles et al.
2005/0189119 A1 9/2005 Gynz-Rekowski
2005/0199298 A1 9/2005 Farrington
2005/0207279 A1 9/2005 Chemali et al.
2005/0241835 A1 11/2005 Burris et al.
2006/0048936 A1 3/2006 Fripp et al.
2006/0048942 A1 3/2006 Moen et al.
2006/0076150 A1 4/2006 Coronado et al.
2006/0086498 A1 4/2006 Wetzel et al.
2006/0108114 A1 5/2006 Johnson
2006/0185849 A1 8/2006 Edwards et al.
2006/0272814 A1 12/2006 Broome et al.
2007/0039741 A1 2/2007 Hailey Jr.
2007/0044962 A1 3/2007 Tibbles
2007/0131434 A1 6/2007 MacDougall et al.
2007/0246210 A1 10/2007 Richards
2007/0246225 A1 10/2007 Hailey Jr., et al.
2008/0035350 A1 2/2008 Henriksen et al.
2008/0053662 A1 3/2008 Williamson et al.
2008/0135249 A1 6/2008 Fripp et al.
2008/0149323 A1 6/2008 O'Malley et al.
2008/0149351 A1 6/2008 Marya et al.
2008/0236839 A1 10/2008 Oddie
2008/0236843 A1 10/2008 Scott et al.
2008/0283238 A1 11/2008 Richards et al.

FOREIGN PATENT DOCUMENTS

GB 1492345 11/1977
GB 2341405 12/2007
JP 59089383 B2 5/1984
SU 1335677 A 9/1987
WO 9403743 A1 2/1994

| | | |
|---|---|---|
| WO | WO 00/79097 | 5/2000 |
| WO | WO 01/65063 | 2/2001 |
| WO | WO 01/77485 | 3/2001 |
| WO | WO 02/075110 | 9/2002 |
| WO | 2004018833 A1 | 3/2004 |
| WO | WO 2006/015277 | 7/2005 |

OTHER PUBLICATIONS

Dikken, Ben J., SPE, Konninkijke/Shell E&P Laboratorium; Pressure Drop in Horizontal Well and Its Effect on Production Performance: Nov. 1990, JPT, Copyright 1990 Society of Petroleum Engineers; pp. 1426-1433.

Stephen P. Mathis, Baker Oil Tools, SPE; "Sand Management: A Review of Approaches and Concerns; SPE 82240"; Presented at the SPE European Formation Damage Conference, Hague, The Netherlands May 13-14, 2003; Copyright 2003, Society of Petroleum Engineers Inc.

E. Paul Bercegeay, University of Southwestern Louisiana; Charles A. Richard, Baker Oil Tools, Inc., Member AIME; "A One-Trip Gravel Packing System, SPE 4771"; Prepared for the Society of Petroleum Engineers of AIME Symposium on Formation Damage Control, New Orleans, La., Feb. 7-8, 1974; Copyright 1974, American Institute of Mining, Metallurgical and Petroleum Engineers, Inc.

Optimization of Commingled Production Using Infinitely Variable Inflow Control Valves; M.M, J. J. Naus, Delft University of Technology (DUT), Shell International Exploration and production (SIEP); J.D. Jansen, DUT and SIEP; SPE Annual Technical Conference and Exhibition, Sep. 26-29 Houston, Texas, 2004, Society of Patent Engineers.

An Oil Selective Inflow Control System; Rune Freyer, Easy Well Solutions; Morten Fejerskkov, Norsk Hydro; Arve Huse, Altinex; European Petroleum Conference, Oct. 29-31, Aberdeen, United Kingdom, Copyright 2002, Society of Petroleum Engineers, Inc.

Determination of Perforation Schemes to Control Production and Injection Profiles Along Horizontal; Asheim, Harald, Norwegian Institute of Technology; Oudeman, Pier, Koninklijke/Shell Exploratie en Producktie Laboratorium; SPE Drilling & Completion, vol. 12, No. 1, March; pp. 13-18; 1997 Society of Petroleum Engineers.

"Rapid Swelling and Deswelling of Thermoreversible Hydrophobically Modified Poly(N-Isopropylacrylamide) Hydrogels Prepared by Freezing Polymerisation", Xue. W., Hamley, I. W. and Huglin, M. B., 2002, 43(1) 5181-5186.

"Thermoreversible Swelling Behavior of Hydrogels Based on N-Isopropiacrylamide with a Zwitterionic Comonomer", Xue, W., Champ. S. and Huglin, M. B. 2001, European Polymer Journal, 37(5) 869-875.

Dinarvand, R., D'Emanuele, A (1995) The use of thermoresponsive hydrogels for on-off release of molecules, J. Control. Ref. 36: 221-227.

Tanaka. T., Nishio, I., Sun, S.T., Ueno-Nisho, S. (1982) Collapse of gels in an electric field, Science, 218:467-469.

Ishihara, K., Hamada, N., Sato, S., Shinohara, I., (1984) Photoinduced selling control of amphiphollic azoaromatic polymer membrane. J. Polym. Sci. Polym. Chem. Ed. 22: 121-128.

Ricka, J. Tanaka, T. (1984) Swelling of Ionic gels: Quantitative performance of the Donnan Thory, Macromolecules, 17: 2916-2921.

* cited by examiner

DOWNHOLE INFLOW CONTROL DEVICE WITH SHUT-OFF FEATURE

CROSS-REFERENCE TO RELATED APPLICATIONS

This application is a Divisional of U.S. patent application, Ser. No. 11/193,182 filed Jul. 29, 2005, now U.S. Pat. No. 7,409,999, which takes priority from U.S. Provisional Application Ser. No. 60/592,496 filed on Jul. 30, 2004.

BACKGROUND OF THE INVENTION

1. Field of the Invention

The invention relates generally to systems and methods for selective control of fluid flow into a production string in a wellbore. In particular aspects, the invention relates to devices and methods for actuating flow control valves in response to increased water or gas content in the production fluids obtained from particular production zones within a wellbore. In other aspects, the invention relates to systems and methods for monitoring flow rate or flow density at completion points and adjusting the flow rate at individual production points in response thereto.

2. Description of the Related Art

During later stages of production of hydrocarbons from a subterranean production zone, water or gas often enters the production fluid, making production less profitable as the production fluid becomes increasingly diluted. For this reason, where there are several completion nipples along a wellbore, it is desired to close off or reduce inflow from those nipples that are located in production zones experiencing significant influx of water and/or gas. It is, therefore, desirable to have a means for controlling the inflow of fluid at a particular location along a production string.

A particular problem arises in horizontal wellbore sections that pass through a single layer of production fluid. If fluid enters the production tubing too quickly, it may draw down the production layer, causing nearby water or gas to be drawn down into the production tubing as well. Inflow control devices are therefore used in association with sand screens to limit the rate of fluid inflow into the production tubing. Typically a number of such inflow governing devices are placed sequentially along the horizontal portion of the production assembly.

The structure and function of inflow control devices is well known. Such devices are described, for example, in U.S. Pat. Nos. 6,112,817; 6,112,815; 5,803,179; and 5,435,393. Generally, the inflow control device features a dual-walled tubular housing with one or more inflow passages laterally disposed through the inner wall of the housing. A sand screen surrounds a portion of the tubular housing. Production fluid will enter the sand screen and then must negotiate a tortuous pathway (such as a spiral pathway) between the dual walls to reach the inflow passage(s). The tortuous pathway slows the rate of flow and maintains it in an even manner.

Inflow control devices currently lack an acceptable means for selectively closing off flow into the production tubing in the event that water and/or gas invades the production layer. Additionally, current inflow control devices do not have an acceptable mechanism for bypassing the tortuous pathway, so as to increase the production flow rate. It would be desirable to have a mechanism for selectively closing as well as bypassing the inflow control device.

The present invention addresses the problems of the prior art.

SUMMARY OF THE INVENTION

The invention provides an improved system and method for controlling inflow of fluid into a production string. In aspects, the invention provides a downhole sand screen and inflow control device with a gas or water shut-off feature that can be operated mechanically or hydraulically from the surface of the well. The device also preferably includes a bypass feature that allows the inflow control device to be closed or bypassed via shifting of a sleeve. In other embodiments, adaptive inflow control devices are positioned along a production string. Exemplary devices can be configured to activate the shut-off feature automatically upon detection of a predetermined gas/oil ratio (GOR) or water/oil ratio (WOR). In other embodiments, the shut-off feature is automatically activated upon detection of fluid density changes or changes in the operating temperature of the inflow control device or flowing fluid. In some embodiments the inflow control devices restrict but not totally shut off fluid flow. In other embodiments, the inflow control devices fully shut off fluid flow.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
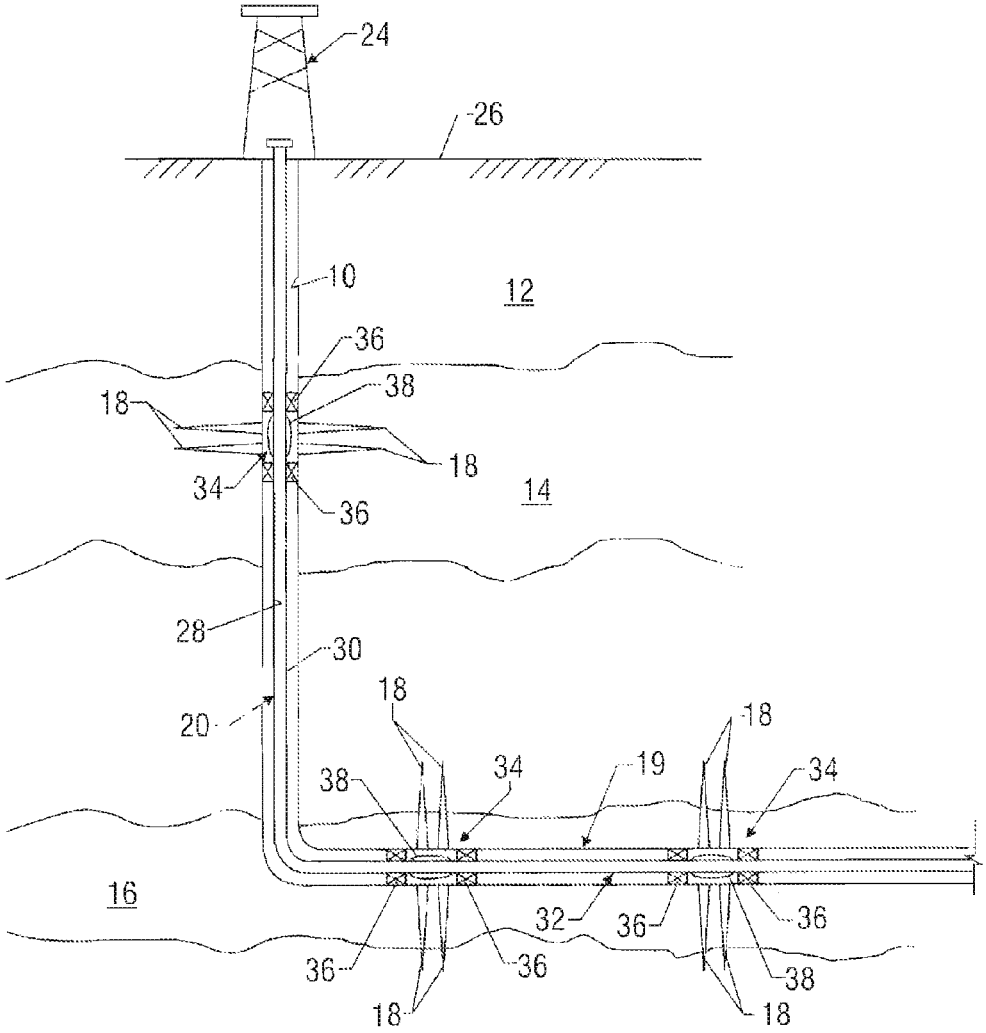
FIG. 1 is a side, cross-sectional view of an exemplary multi-zonal wellbore and production assembly which incorporates an inflow control system in accordance with the present invention.

FIG. 1 depicts an exemplary wellbore 10 that has been drilled through the earth 12 and into a pair of formations 14, 16 from which it is desired to produce hydrocarbons. The wellbore 10 is cased by metal casing, as is known in the art, and a number of perforations 18 penetrate and extend into the formations 14, 16 so that production fluids may flow from the formations 14, 16 into the wellbore 10. The wellbore 10 has a deviated, or substantially horizontal leg 19. The wellbore 10 has a late-stage production assembly, generally indicated at 20, disposed therein by a tubing string 22 that extends downwardly from a wellhead 24 at the surface 26 of the wellbore 10. The production assembly 20 defines an internal axial flowbore 28 along its length. An annulus 30 is defined between the production assembly 20 and the wellbore casing. The production assembly 20 has a deviated, generally horizontal portion 32 that extends along the deviated leg 19 of the wellbore 10. At selected points along the production assembly 20 are production nipples 34. Optionally, each production nipple 34 is isolated within the wellbore 10 by a pair of packer devices 36. Although only two production nipples 34 are shown in FIG. 2, there may, in fact, be a large number of such nipples arranged in serial fashion along the horizontal portion 32.

Each production nipple 34 features an inflow control device 38 that is used to govern the rate of inflow into the production assembly 20. In accordance with the present invention, the inflow control device 38 may have a number of alternative constructions that ensure selective operation and controlled fluid flow therethrough. In certain embodiments, the inflow control devices are responsive to control signals transmitted from a surface and/or downhole location. In other embodiments, the inflow control devices are adaptive to the wellbore environment. Exemplary adaptive inflow control devices (or "AICD") can control flow in response to changes in ratios in fluid admixtures, temperatures, density and other such parameters.

Figure 1A:
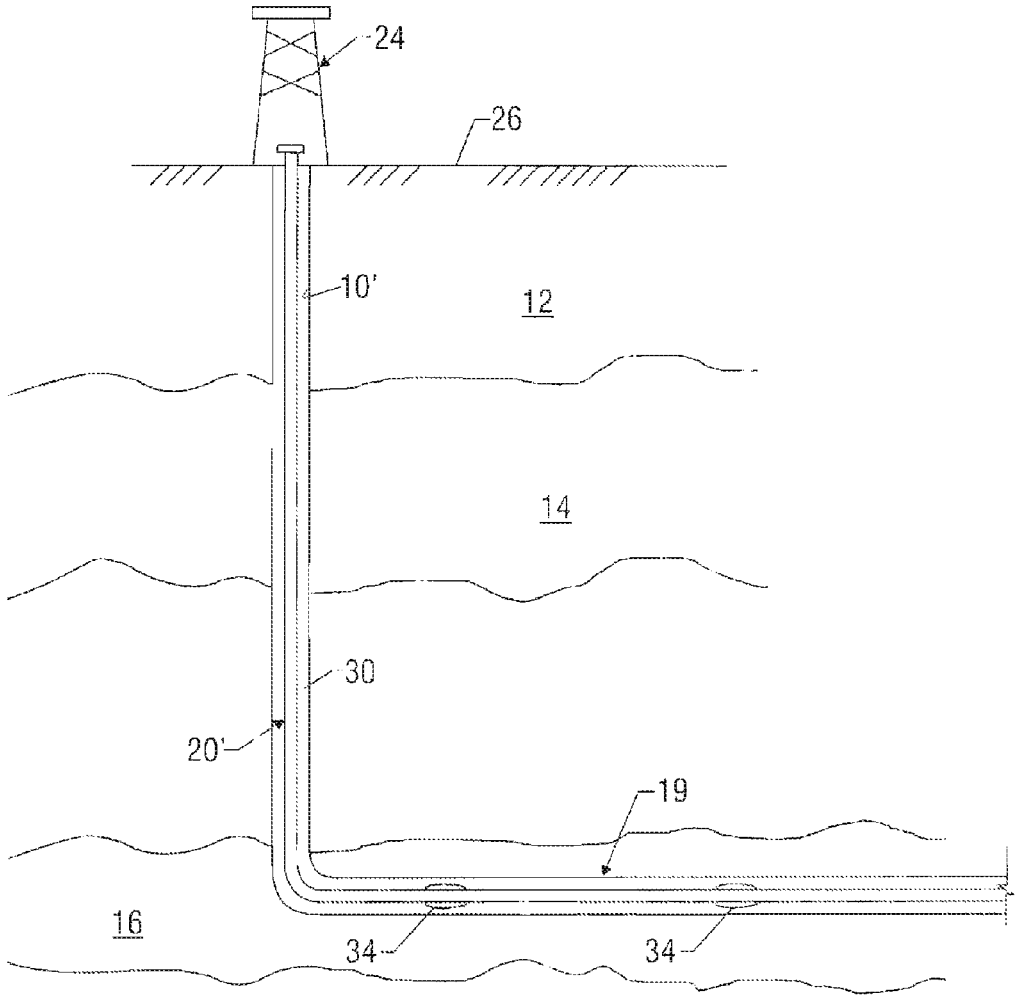
FIG. 1A is a side, cross-sectional view of an exemplary open hole production assembly which incorporates an inflow control system in accordance with the present invention.

FIG. 1*a* illustrates an exemplary open hole wellbore arrangement 10' wherein the inflow control devices of the present invention may be used. Construction and operation of the he open hole wellbore 10' is similar in most respects to the wellbore 10 described previously. However, the wellbore arrangement 10' has an uncased borehole that is directly open to the formations 14, 16. Production fluids, therefore, flow directly from the formations 14, 16, and into the annulus 30 that is defined between the production assembly 20' and the wall of the wellbore 10'. There are no perforations 18, and typically no packers 36 separating the production nipples 34. The nature of the inflow control device is such that the fluid flow is directed from the formation 16 directly to the nearest production nipple 34, hence resulting in a balanced flow.

Figure 2:
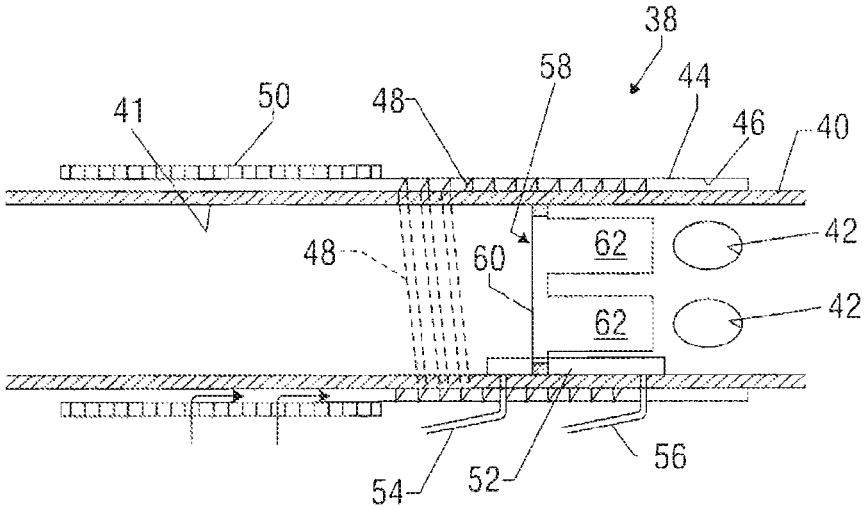
FIG. 2 is a side, cross-sectional view of a first exemplary sand screen flow control device in a valve-open configuration.
Figure 3:
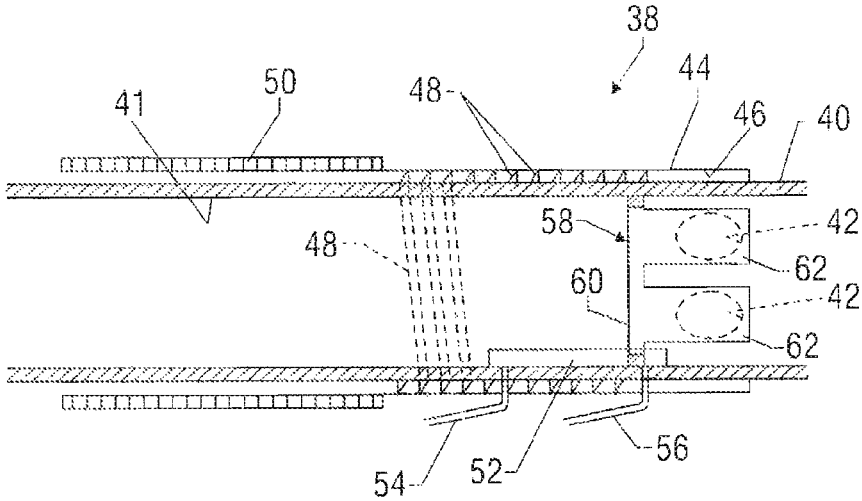
FIG. 3 is a side, cross-sectional view of the sand screen flow control device shown in FIG. 2, now in a valve-closed configuration.

Referring now to FIGS. 2 and 3, there is shown, in side, cross-section, a first exemplary inflow control device 38 that includes an tubular housing 40 which defines an interior flowbore 41. Fluid flow apertures 42 are disposed through the housing 40. A sleeve 44 surrounds a portion of the housing 40 and defines a fluid flowspace 46 therein. A helical thread 48 surrounds the housing and winds through the flowspace 46. A porous sand screen 50 surrounds one end portion of the housing 40. A hydraulic chamber 52 is disposed within the housing 40. First and second hydraulic control lines 54, 56 are operably interconnected with the hydraulic chamber 52 to supply and remove hydraulic fluid therefrom. The hydraulic control lines 54, 56 extend to a remote hydraulic fluid supply (not shown), which may be located at the surface 26. The closing sleeve 58 is slidably retained within the flowbore 41 of the housing 40. The closing sleeve 58 includes an annular ring portion 60 and a plurality of axially extending fingers 62. The annular ring portion 60 at least partially resides within the hydraulic chamber 52. The fingers 62 are shaped and sized to cover the inflow apertures 42.

The inflow control device 38 is normally in the open position shown in FIG. 2, wherein production fluid can pass through the sand screen 50 and into the flowspace 46. The production fluid negotiates the tortuous path provided by thread 48 and enters the flowbore of the housing 40 via apertures 42. The device 38 may be closed against fluid flow by shifting the closing sleeve 58 to the closed position shown in FIG. 3 so that the fingers 62 cover the apertures 42. The sleeve 58 is shifted to the closed position by injecting pressurized hydraulic fluid through hydraulic control line 54. The fluid acts upon the ring portion 60 of the sleeve 58 to urge it axially within the flowbore 41. If it is desired to reopen the inflow control device 38 to fluid flow, this may be accomplished by injecting pressurized fluid into the second hydraulic line 56 to urge the sleeve member 60 back to the position shown in FIG. 2. Pressurization of the conduits 54, 56 may be accomplished from the surface 26 manually or using other techniques known in the art.

Figure 6:
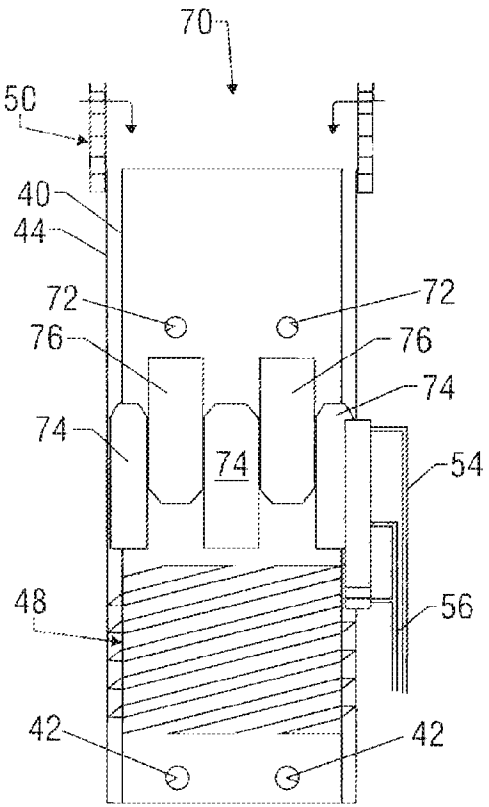
FIG. 6 is a side, cross-sectional view of the sand screen flow control device in a bypass configuration.
Figure 5:
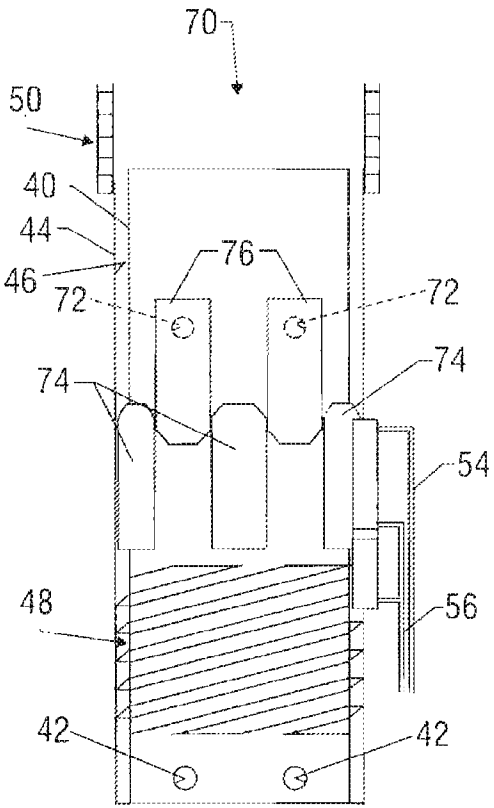
FIG. 5 is a side, cross-sectional view of the sand screen flow control device in a valve-closed configuration.
Figure 4:
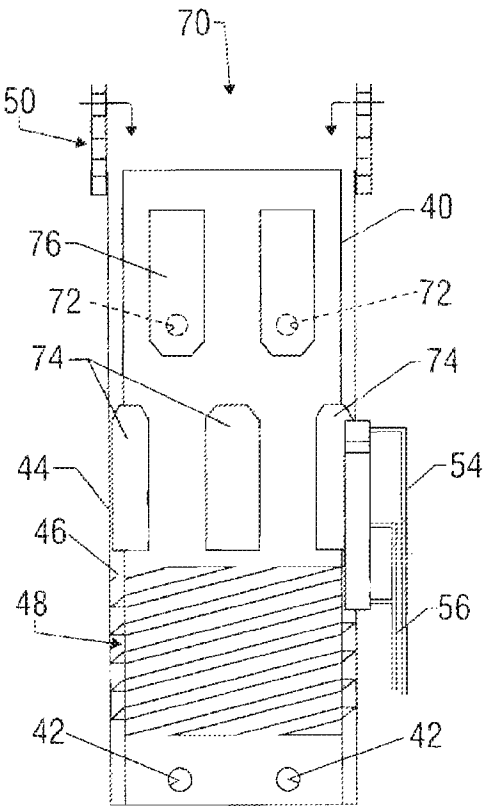
FIG. 4 is a side, cross-sectional view of a second exemplary sand screen flow control device in a valve-open configuration.

FIGS. 4-6 illustrate an alternative exemplary inflow control device 70. Except where noted, construction and operation of the inflow control device 70 is the same as the inflow control device 38. Portions of the inflow control device 70 are shown in schematic fashion for clarity. Fluid bypass ports 72 are disposed through the tubing section 38 upstream of the helical thread 48. A plurality of plates 74 are secured in a fixed manner outside of the housing 40 and within the flowspace 46. Fingers 76 also reside within the flowspace 46 and are secured to a sliding sleeve valve member (not shown) similar to the sleeve member 58 described earlier. The fingers 76 are shaped and sized to slide between the plates 74 in an interlocking fashion. Initially, the fingers 76 cover bypass ports 72, as FIG. 4 depicts. The fingers 76 may be affixed to an annular ring (not shown), similar to the annular ring 60 described earlier, and moved within the flowspace 46 by selective pressurization of hydraulic chamber 52, via control lines 54, 56.

In operation, the inflow control device 70 is moveable between three positions, illustrated by FIGS. 4, 5, and 6, respectively. In the first position (FIG. 4) the inflow control device is configured to provide controlled flow into the housing 40. Fluid enters the sand screen 50 and proceeds along the flowspace 46 and between plates 74 to helical thread 48. Upon exiting the threaded portion 48, the fluid can enter the housing 40 via apertures 42. This is the typical mode of operation for the inflow control device 70. If it desired to close off fluid flow through the device 70, this is accomplished by moving the fingers 76 axially to the position shown in FIG. 5. In this position, the fingers 76 interlock with plates 74 to block fluid flow along the flowspace 46. Production fluid can no longer enter the housing 40 via apertures 42.

The inflow control device 70 also includes a third configuration, a bypass configuration, that allows production fluid to enter the housing 40 without passing through the flow restricting helical thread 48. The bypass configuration, illustrated in FIG. 6, is used when it is desired to increase flow through the device 70 to a greater extent than the normal open position allows. To move the device 70 into the bypass position, the fingers 76 are moved axially to the position shown in FIG. 6, such that the bypass ports 72 become unblocked by the fingers 76. Production fluid can now flow into the sand screen 50 and along the flowspace 46 to the bypass ports 76, wherein it will enter the housing 40.

Figure 7:
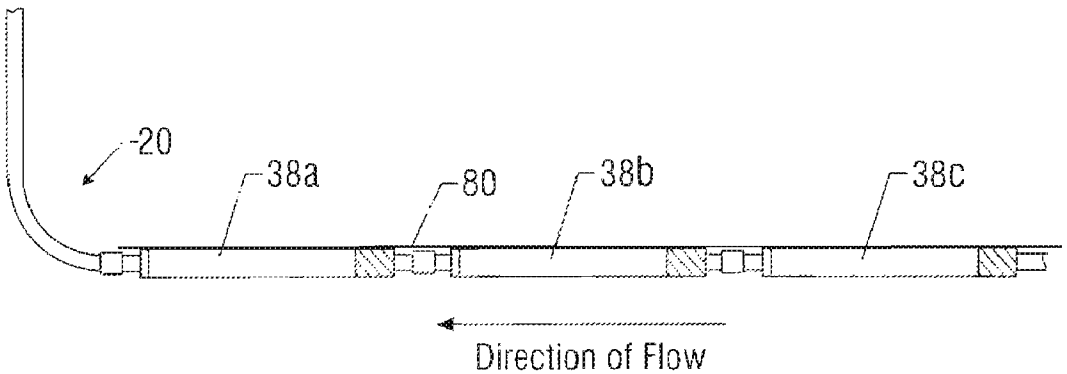
FIG. 7 illustrates the use of distributed temperature sensing devices for the conduct of flow control within a production assembly.
Figure 7A:
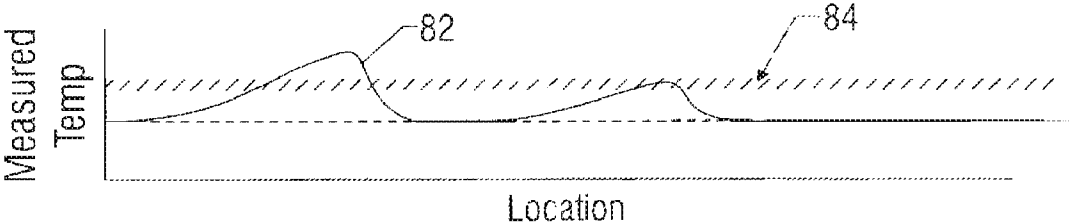
FIG. 7A is a graph of measured temperature vs. location.

In addition to actuating the inflow control devices 38, 70 between their respective positions or configurations manually, they may also be actuated automatically in response to a detected downhole condition, such as the temperature of the device itself, the temperature of the flowing fluid, and/or changes in fluid density. FIGS. 7 and 7A illustrate the application of a distributed temperature sensing system to control fluid flow into the production string 20. FIG. 7 depicts a production string 20 with three production nipples 38*a*, 38*b*, 38*c* which incorporate inflow control devices of the types described previously. An optical fiber cable 80 extends along the production string 20 in contact with each of the production nipples 38*a*, 38*b*, 38*c*. The optical fiber cable 80 extends upwardly to the surface 26 and is a component of a distributed temperature sensing (DTS) system. DTS systems are known systems that are used to detect and monitor operating temperature and display measured temperature in a linearized fashion. FIG. 7A depicts an exemplary DTS system graphic display wherein temperature is measured at each of the production nipples 38*a*, 38*b*, 38*c*. The operating temperature of the production nipples 38*a*, 38*b*, 38*c* will increase as flow rate into the production string 20 through them. Fluid flow rate will increase substantially as the gas/oil ratio (GOR) and/or water/oil ratio (WOR) within the production fluid rises. Thus, an increased temperature will indicate a higher gas and/or water content. In the illustrated case, there is a high flow rate for the first nipple 38*a*, a standard flow rate for the second nipple 38*b*, and a low flow rate for the third production nipple 38*c*. In FIG. 7A, the measured temperature is depicted, by location, as graph line 82 and compared to a baseline normal operating temperature range 84. Graphical depiction of the measured temperature in this manner will allow an operator at the surface 26 to actuate the inflow control device of production nipple 38*a* to reduce or close off flow through that nipple 38*a*. If Production nipple 38*c* is equipped with an inflow control device of the type described above as 70, then an operator may attempt to correct the low flow condition by actuating that inflow control device to move it to its bypass configuration.

Figure 8:
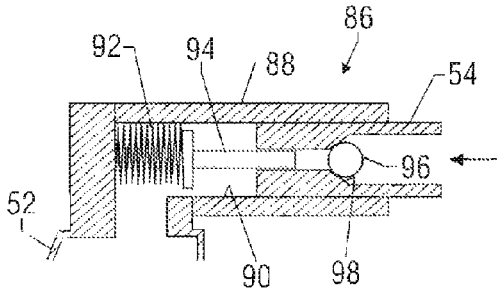
FIG. 8 illustrates an exemplary valve actuator in an initial closed position.
Figure 9:
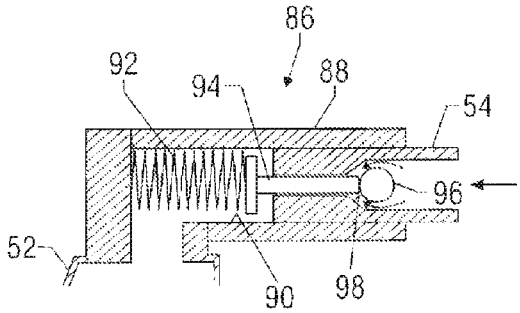
FIG. 9 depicts the actuator shown in FIG. 8 now in an open position.

FIGS. 8 and 9 depict an exemplary automatic valve actuator 86 which may be used with the first hydraulic control line 54 of the inflow control device 38 in order to automatically close fluid flow in the event of increased operating temperatures associated with a high GOR or WOR. Hydraulic line 54 contains pressurized hydraulic fluid, and the actuator 86 is disposed between this fluid and the hydraulic chamber 52 described earlier. The actuator 86 includes an outer housing 88 that encloses a flowpath 90. An expandable element 92 is retained within the flowpath 90 and is fashioned of a heat-sensitive shape memory alloy, of a type known in the art to expand in size or shape under high temperatures and to retract to its original size or shape in response to cooler temperatures. The actuator 86 also includes a rod 94 and a ball member 96 that is seated upon a ball seat 98.

When the production nipple 38 is operating at or below expected operating temperatures, the valve actuation element 86 is in the position shown in FIG. 8, and the ball member 96 blocks passage of pressurized fluid into the hydraulic chamber 52. However, when the operating temperature rises past a predetermined limit, the element 92 expands, urging the rod 94 against the ball member 96 and opening the flowpath 90. Pressurized fluid will enter the hydraulic chamber 52 and cause the sleeve member 58 to close the fluid apertures 42 to flow, as described previously. When the operating temperature has returned to normal or below normal, the element 92 will retract to its initial shape or size, allowing the ball member 96 to once again block fluid flow into the hydraulic chamber 52.

Figure 10:
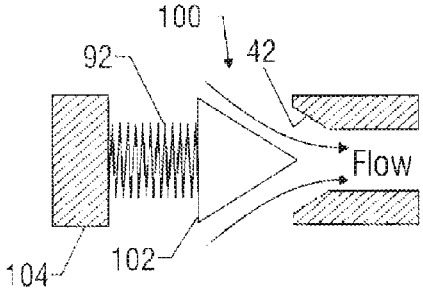
FIG. 10 illustrates an exemplary temperature-actuated cone valve assembly in an initial open position.
Figure 11:
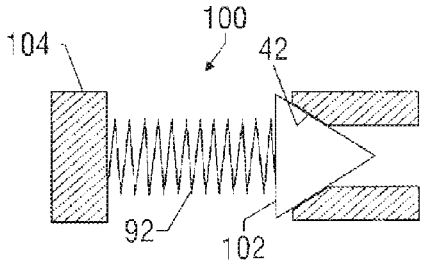
FIG. 11 illustrates the cone valve assembly of FIG. 10 now in a closed position.

FIGS. 10 and 11 depict an exemplary heat-sensitive valve element 100 that may be used to selectively block the flow apertures 42 during high operating temperatures. The valve element 100 includes a valve closure member 102 that is interconnected with a valve base 104 by an expandable element 92. The valve closure member 102 is shaped and sized to be complimentary to the aperture 42. While at normal operating temperatures, the valve element 100 is in the configuration shown in FIG. 10, with flow through the aperture 42 occurring. When the operating temperature rises above a predetermined level, the expandable element 92 expands to bring the closure member 102 into sealing engagement with the aperture 42, thereby closing off flow through the aperture 42. When operating temperature returns to normal or below normal, the expandable element 92 return to the configuration shown in FIG. 10, with flow through the aperture 42 once again occurring.

FIGS. 12-15 depict a further exemplary automatically actuatedvalve element 110 having a hydraulic backup feature. The valve element 110 is constructed similar to the valve element 100 described previously. However, the valve closure member 112 includes an engagement portion 114. A hydraulic chamber 116 and actuation arm 118 are also associated with the valve element 110. The actuation arm 118 is moved axially by selective pressurization of portions of the hydraulic chamber 116.

Figure 12:
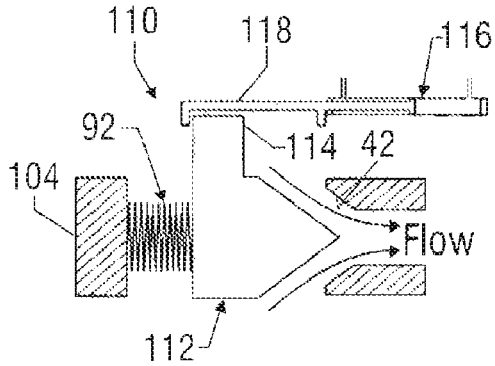
FIG. 12 depicts an exemplary heat actuated valve assembly with a hydraulic backup system, in an initial open position.
Figure 13:
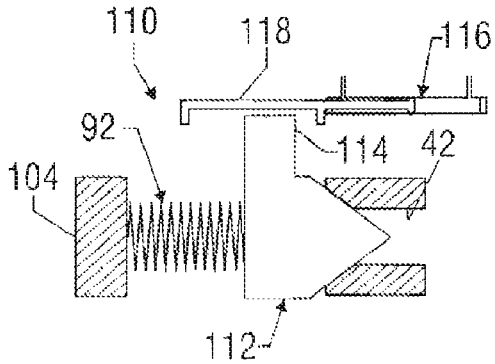
FIG. 13 illustrates the valve assembly shown in FIG. 12 now having been closed via temperature change.
Figure 14:
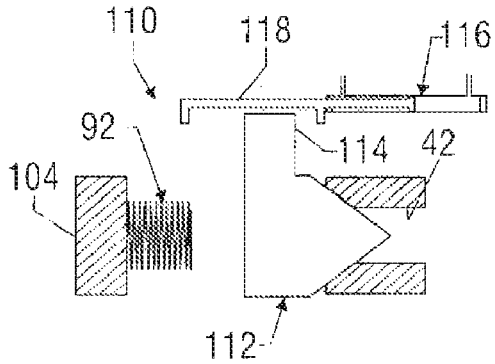
FIG. 14 shows the valve assembly shown in FIGS. 12 and 13 remaining in the closed position following subsequent change of temperature.
Figure 15:
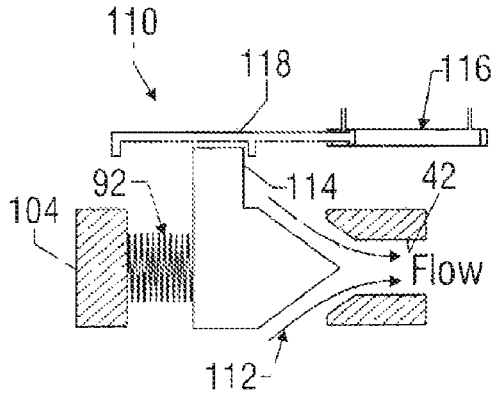
FIG. 15 depicts the valve assembly shown in FIGS. 12-14 having been reopened by the hydraulic backup system.

During operation at normal or below normal operating temperatures, the valve element 110 is initially in the configuration shown in FIG. 12. When the operating temperature rises past a predetermined level, the expandable element 92 expands to urge the valve closure member 112 into engagement with the aperture 42, closing it against fluid flow therethrough (see FIG. 13). Normally, when the operating temperature then drops below the predetermined level, the expandable element 92 will retract and withdraw the closure member 112. In the configuration shown in FIG. 14, however, the closure member 112 has failed to retract. The hydraulic chamber 116 may then be pressurized to cause the actuating arm 118 to move axially, engaging the engagement portion 114 to pull the closure member 112 away from the aperture 42, restoring flow therethrough.

Figure 16:
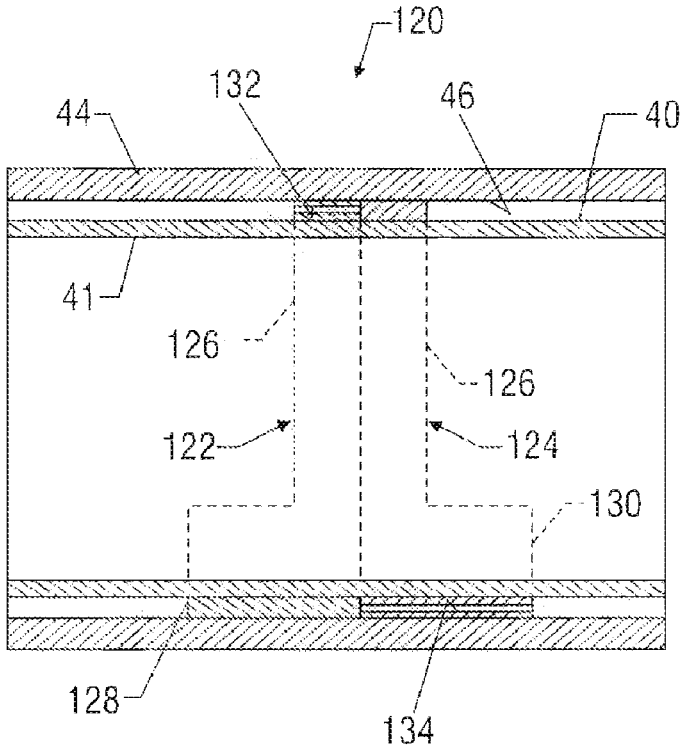
FIG. 16 shows an exemplary valve assembly that is actuated in response to changes in fluid density with the valve in a closed position.
Figure 17:
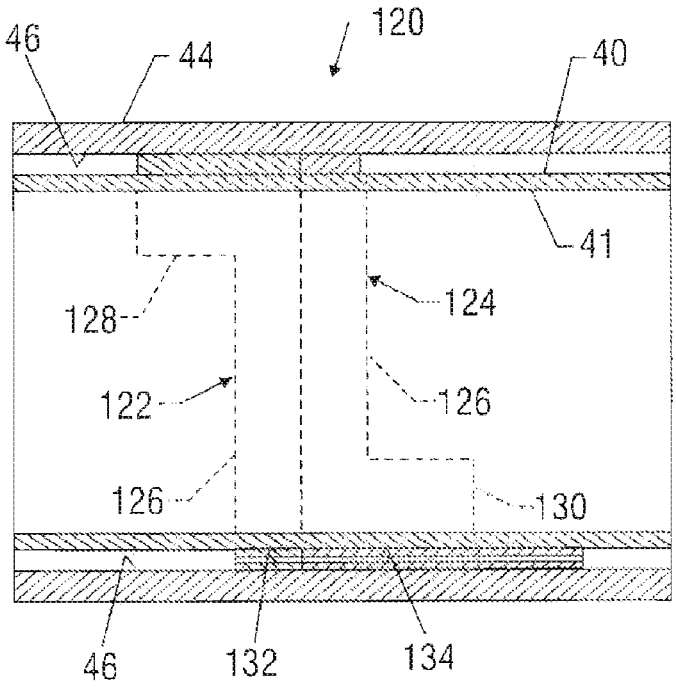
FIG. 17 shows the valve assembly of FIG. 16, now with the valve in an open position.

FIGS. 16 and 17 illustrate an exemplary valve assembly 120 that is responsive to changes in production fluid density. An exemplary density-sensitive valve assembly 120 is incorporated into a section of an inflow control device 38 or 70 between the sand screen 50 and the fluid apertures 42. The valve assembly 120 is made up of a pair of valve members 122, 124 which reside within the flowspace 46 defined between the inner housing 40 and the outer sleeve 44 and are free to rotate within the flowspace 46. The valve members 122, 124 maybe made of bakelite, Teflon® hollowed steel or similar materials that are fashioned to provide the operable density parameters that are discussed below. Each of the valve members 122, 124 includes an annular ring portion 126. The first valve member 122 also includes an axially extending float portion 128. The second valve member 124 includes an axially extending weighted portion 130. The weighted portion 130 is preferably fashioned of a material with a density slightly higher than that of water. The presence of the weighted portion 130 ensures that the second valve member 124 will rotate within the flowspace 46 so that the weighted portion 130 is in the lower portion of the flowspace 46 when in a substantially horizontal run of wellbore. The float portion 128 of the first valve member 122 is density sensitive so that it will respond to the density of fluid in the flowspace 146 such that, in the presence lighter density gas or water, the valve member 122 will rotate within the flowspace 46 until the float portion 128 lies in the upper portion of the flowspace (see FIG. 17). However, in the presence of higher density oil, the valve member 122 rotates so that the float portion 128 lies in the lower portion of the flowspace 46 (see FIG. 16).

In the first valve member 122, the ring portion 126 opposite the float portion 128 contains a first fluid passageway 132 that passes axially through the ring portion 126. In the second valve member 124, a second fluid passageway 134 passes axially through the ring portion 126 and the weighted portion 130. It can be appreciated with reference to FIGS. 16 and 17 that fluid flow along the flowspace 46 is only permissible when the first and second passageways 132, 134 are aligned with each other. This will only occur when there is sufficient fluid density to keep the first valve member 122 in the position shown in FIG. 17. It should be appreciated that these figures merely shown one embodiment of the present invention. In other embodiments, restriction to fluid flow can be achieved with a density-sensitive device that uses linear directed movement that closes or minimized flow ports; e.g., an annular mounted density-sensitive plugs or flapper.

Figure 18:
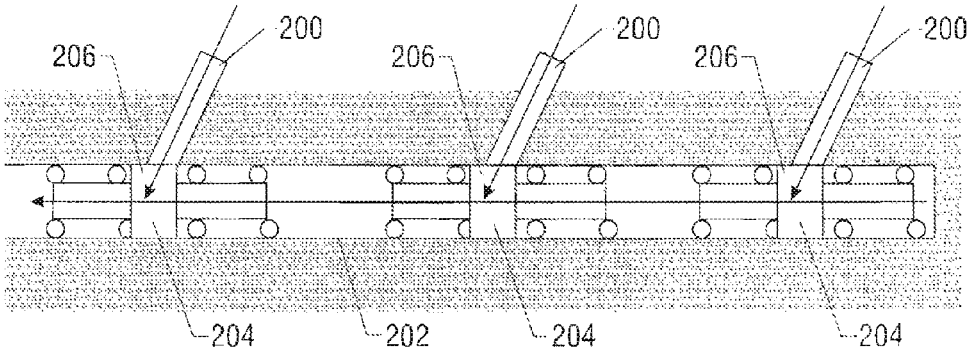
FIG. 18 shows embodiments of inflow control devices used in conjunction with a main wellbore having at least one branch wellbore.
Figure 19:
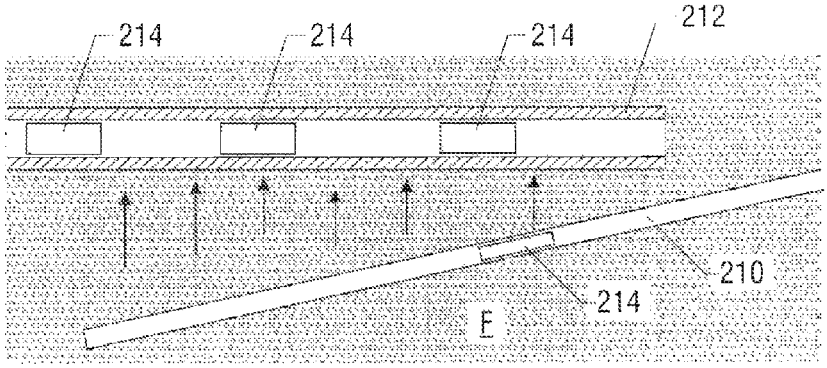
FIG. 19 shows embodiments of inflow control devices used in conjunction with a main wellbore and an adjacent ditch wellbore.

In other aspects of the present invention, inflow control devices (ICD's) are utilized to control the flow of commingled fluids drained via two or more wellbores. The wellbore are in fluid communication but not necessary physically connected. Referring now to FIG. 18, in one scheme, one or more branch bores 200 are drilled from a main bore 202. In this arrangement, ICD's 204 are positioned adjacent or upstream of junctions 206 between the main bore 202 and branch bores 202. The ICD's 204 can control the commingled flow from each of the branch bores 202. Referring now to FIG. 19, in another arrangement, one or more ditch wells 210 are drilled adjacent a main wellbore 22. The ditch well 210 have trajectories selected to drain hydrocarbons from the formation F and direct the drained fluid to main wellbore 212. The ditch wells can be either open hole bores or completed wellbores. The ICD's 214 are distributed along the main bore at selected locations to control or otherwise modulate the flow of commingled fluids. Additionally, in some applications, the ICD's 214 can be positioned in the ditch well 210 control flow from the ditch well 210 and surrounding formation to the main wellbore 212. In any event, the ICD restricts or permits flow based on the nature of the produced fluid. The ICD's can be configured to restrict the flow of commingled fluid based a parameter such as water cut as described previously. The inflow control devices are deployed in conjunction with a screen, isolation devices such as packers, sealing elements or other devices that provide zonal isolation and flow control in a manner previously described. A separate inflow control device can be utilized adjacent each junction.

For the sake of clarity and brevity, descriptions of most threaded connections between tubular elements, elastomeric seals, such as o-rings, and other well-understood techniques are omitted in the above description. Further, terms such as "valve" are used in their broadest meaning and are not limited to any particular type or configuration. The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. A method of selectively controlling fluid flow in a main wellbore drilled in a formation, comprising:

drilling a secondary wellbore adjacent to a main wellbore such that fluid produced from the secondary wellbore commingles with the fluid in the main wellbore, wherein the secondary wellbore does not intersect the main wellbore;

positioning an in-flow control device in a main wellbore; and controlling the flow of the commingled fluid in the main wellbore with the in-flow control device.

2. The method of claim 1 further comprising positioning a plurality of in-flow control devices along the main wellbore.

3. The method of claim 1 further comprising positioning at least one in-flow control device in the secondary wellbore.

4. The method of claim 1 further comprising configuring the in-flow control device to control flow based on a nature of the commingled fluid.

5. The method of claim 1 further comprising configuring the in-flow control device to control flow based on a water cut of the commingled fluid.

6. The method of claim 1 further comprising configuring the in-flow control device to be sensitive to a density of the commingled fluid.

7. The method of claim 1 wherein the secondary well has a trajectory selected to direct a fluid to the main wellbore.

8. The method of claim 1 further comprising draining a formation using the secondary wellbore.

9. A method of selectively controlling fluid flow in a main wellbore drilled in a formation, comprising:

positioning an in-flow control device in a main wellbore, wherein a secondary wellbore that does not intersect the main wellbore produces a fluid that commingles with the fluid in the main wellbore, the in-flow control device being configured to control the flow of the commingled fluid.

10. The method of claim 9 further comprising positioning a plurality of in-flow control devices along the main wellbore.

11. The method of claim 9 further comprising positioning at least one in-flow control device in the secondary wellbore.

12. The method of claim 9 further comprising configuring the in-flow control device to control flow based on a nature of the commingled fluid.

13. The method of claim 9 further comprising configuring the in-flow control device to control flow based on a water cut of the commingled fluid.

14. The method of claim 9 further comprising configuring the in-flow control device to be sensitive to a density of the commingled fluid.

15. The method of claim 9 wherein the secondary well has a trajectory selected to direct a fluid to the main wellbore.

16. The method of claim 9 further comprising draining a formation using the secondary wellbore.

17. A method of selectively controlling fluid flow in a main wellbore, comprising:

drilling a secondary wellbore that is adjacent to but does not intersect the main wellbore;

producing a fluid from the secondary wellbore that commingles with the fluid in the main wellbore; and controlling the flow of the commingled fluid in the main wellbore with an in-flow control device.

18. The method of claim 17 wherein the in-flow control device is configured to control flow based on a nature of the commingled fluid.

19. The method of claim 17 wherein the in-flow control device is configured to control flow based on a water cut of the commingled fluid.

20. The method of claim 17 wherein the in-flow control device is configured to be sensitive to a density of the commingled fluid.

21. The method of claim 17 wherein the secondary well has a trajectory selected to direct fluid to the main wellbore.

22. The method of claim 17 further comprising draining a formation using the secondary wellbore.

* * * * *